United States Patent [19]

Zumfeld et al.

[11] Patent Number: 4,738,093

[45] Date of Patent: Apr. 19, 1988

[54] AUTOMOTIVE SPLICER FOR SPLICING ENDS OF SPUN YARN AND A METHOD OF SPLICING SPUN YARNS

[75] Inventors: Heinz Zumfeld; Reinhard Mauries, both of Monchengladbach, Fed. Rep. of Germany

[73] Assignee: W. Schlafhorst & Co., Fed. Rep. of Germany

[21] Appl. No.: 21,158

[22] Filed: Mar. 3, 1987

[30] Foreign Application Priority Data

May 3, 1986 [DE] Fed. Rep. of Germany ..... 3607206

[51] Int. Cl.[4] ..... D01H 15/00

[52] U.S. Cl. ..... 57/22; 57/263

[58] Field of Search ..... 57/22, 261, 263, 301

[56] References Cited

U.S. PATENT DOCUMENTS

| | | | |
|---|---|---|---|
| 4,356,688 | 11/1982 | Zurcher et al. | 57/22 |
| 4,406,115 | 9/1973 | Negaty-Hindi et al. | 57/22 |
| 4,411,128 | 10/1983 | Mima | 57/22 |
| 4,445,318 | 5/1984 | Becker et al. | 57/22 |
| 4,499,715 | 2/1985 | Chardon et al. | 57/22 |
| 4,610,132 | 9/1986 | Rohner et al. | 57/22 |

*Primary Examiner*—Donald Watkins

*Attorney, Agent, or Firm*—Shefte, Pinckney & Sawyer

[57] ABSTRACT

An automatic splicer for spun yarn, including open end spun yarn. Opposite yarn ends for splicing are inserted in opposed yarn clamping devices, adjacent yarn loop pulling devices, in a splicing slot of a splicing chamber, adjacent mechanical combing devices and in yarn severing devices. Excess yarn is cut from the yarn ends by the yarn severing devices at a predetermined distance from the splicing slot and the yarn loop pulling devices are advanced to pull the ends of the yarns to the combing devices at which air is applied to the yarn ends to direct the yarn ends to the combing devices. The yarn loop pulling devices are then partially retracted to feed the yarn ends into the combing devices at a controlled rate of feed for combing the yarn ends progressively from their ends to a length corresponding approximately to the length of the subsequent splice. The yarn loop pulling devices are then advanced further to withdraw the yarn ends from the clamping devices and into alignment in the splicing slot in which compressed air is applied to splice the yarn ends. The combing devices are rollers with needle clothing and they may be driven by the force of the air that is applied to the yarn ends to direct the yarn ends to the combing devices. Yarn feed slots may be formed in the splicing chamber extending transversely from the splicing slot to combing devices, in which case the severing and application of air for directing the yarn ends may be performed sequentially for the two yarns to avoid both yarn ends being drawn into the same feed slot.

25 Claims, 5 Drawing Sheets

AUTOMOTIVE SPLICER FOR SPLICING ENDS OF SPUN YARN AND A METHOD OF SPLICING SPUN YARNS

BACKGROUND OF THE INVENTION

The present invention relates to an automatic splicer for splicing ends of spun yarn, including plied and wrapped yarns, and a method of splicing such spun yarns, and more particularly to an automatic splicer and method wherein yarn ends are mechanically combed to form the end in enhanced condition for producing an effective splice.

Automatic splicers for splicing ends of yarn broken during operation of yarn and other textile manufacturing and processing equipment are well known. Air splicers, in particular, have been developed for this purpose and have been improved over the years. However, by their nature air splicers require the yarn ends to be cleaned of loose fibers and opened so that the splicing air blast can create a strong commingling interconnection and twisting of fibers that are firmly connected in each yarn end and firmly connected to each other during splicing, and problems have, therefore, persisted in obtaining rapid, efficient and effective cleaning and opening of the yarn ends for air splicing the general range of different types of yarn. End preparation has included such means as air jets blown at the yarn ends or acting on the yarn ends within conduits or mechanical combing devices of various sorts. Typical of such prior art devices and methods are disclosed in U.S. Pat. No. 4,499,715 and U.S. Pat. No. 4,610,132, owned by the assignee of the present application.

The problem of end preparation is especially acute when attempting to splice open end spun yarns due to the inherent nature of such yarns, which have a core of interior fibers that have considerably more twist than the outer last-applied fibers that form a somewhat untwisted wrap, the fibers of which are not firmly attached to the yarn and tend to be readily displaced into accumulation that can interfere with splicing. This often occurs, for example, when ends of open end spun yarns are inserted in a mechanical combing device in preparation for splicing. It is also a problem when attempting to mechanically comb plied spun yarns and wrapped or sheathed yarn.

SUMMARY OF THE INVENTION

By the present invention as automatic splicer for splicing ends of spun yarn, including plied yarns, and a method of splicing spun yarsn is provided that effectively prepares or opens yarn ends for splicing without tearing off the end of the yarn and without leaving any significant accumulation of fibers, windings or impurities and provides an open tuft suitable for splicing, even when splicing spun yarns produced on open end spinning machines, plied yarns and wrapped or sheathed yarn.

Briefly described, the method of the present invention includes feeding yarn ends to mechanical combing means at a controlled feed rate to comb the yarn ends progressively from their ends to a predetermined length corresponding approximately to the length of the subsequent splice, withdrawing the combed yarn ends from the combing means and into alignment for splicing, and splicing the combed and aligned yarn ends. This provision for progressive combing results in a progressive cleaning and cleaning of fibers, windings, and impurities without the accumulation of material that is not easily removed when a yarn end is inserted in a combing device without progressive controlled feeding.

The method of the present invention preferably is practiced in conjunction with a splicing chamber in which compressed air is used to effect the splice. Also, air is applied to the yarn ends to direct them toward the combing means during the progressive feeding and preferably before feeding begins.

The method preferably includes pulling the yarn ends toward splicing alignment to position them for feeding to the combing means and then feeding the yarn ends away from splicing alignment to the combing means progressively and ends first. In the preferred embodiment this yarn end manipulation is accomplished by advancing and retracting yarn loop pulling means. The length of the yarn ends to be combed and spliced is determined by severing exceess yarn from the yarn ends at a predetermined spacing from splicing alignment prior to pulling the yarn ends into position for feeding to the combing means.

In one form of the present invention, the application of air to direct the yarn ends toward the combing means also applies the air to drive the combing means. In another form of the invention the yarn ends are spliced in a splicing chamber that has a splicing slot and also has yarn feeding slots extending transversely from the splicing slot to the combing means with air being applied to the feeding slots to direct the yarn ends toward the combing means. In this latter form of the method of the present invention, the application of air to direct the yarn ends through the transverse slot to the combing means may be performed for one yarn end while the other yarn end is being held out of interference and then subsequently applying air and combing the other yarn end.

The automatic splicer of the present invention provides means for performing the described method. Preferably the combing means is in the form of a freely rotatable roller having a cylindrical combing surface clothed with combing teeth and using the air that directs the yarn end to the combing means as means for driving the combing roller by appplication of the air to the combing teeth.

In the preferred embodiment of the automatic splicer of the present invention, a pair of yarn clamping means are provided for clamping a yarn to be spliced in each clamping means. A pair of yarn severing means are provided between the yarn clamping means for severing excess yarn from the ends of yarn clamped by opposite clamping means. A pair of yarn loop pulling means are provided between the yarn severing means for pulling yarn loops in yarns clamped in adjacent clamping means. A pair of mechanical yarn combing means are provided between the yarn loop pulling means for combing the ends of yarns clamped in the opposite clamping means. Means are associated with each yarn combing means for applying air to direct the yarn ends to the combing means. A splicing chamber is provided between the combing means and having a slot for splicing yarn ends therein by the action of air splicing means. The yarn loop pulling means is operable to advance to pull the severed yarn ends into position for feeding to the pair of combing means and is retractable to feed the yarn ends into the combing means at a controlled feed rate under the influence of the air from the air applying means to comb the yarn ends progressively from their ends to a predetermined length corresponding approximately to the length of the subsequent splice. The yarn loop pulling means then is operable to advance to withdraw the yarn ends from the combing means and into alignment in the splicing slot for splicing.

DETAILED DESCRIPTION OF THE PREFERRED EMBODIMENTS

Figure 1:
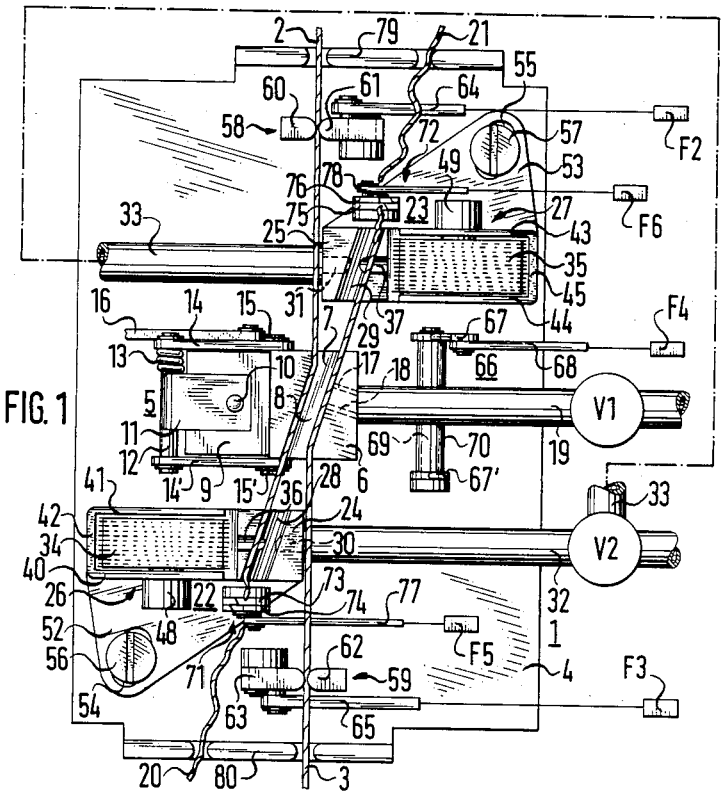
FIG. 1 is a front elevation of the preferred embodiment of the automatic yarn splicer of the present invention with actuating mechanisms and pneumatic controls shown schematically.
Figure 2:
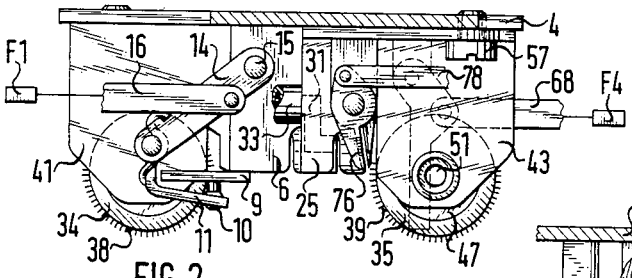
FIG. 2 is a plan view of the automatic splicer of FIG. 1.
Figure 3:
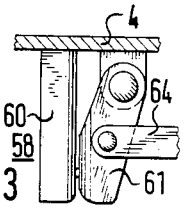
FIG. 3 is an enlarged plan of the yarn clamping means illustrated in the upper portion of the automatic splicer illustrated in FIG. 1.
Figure 4:
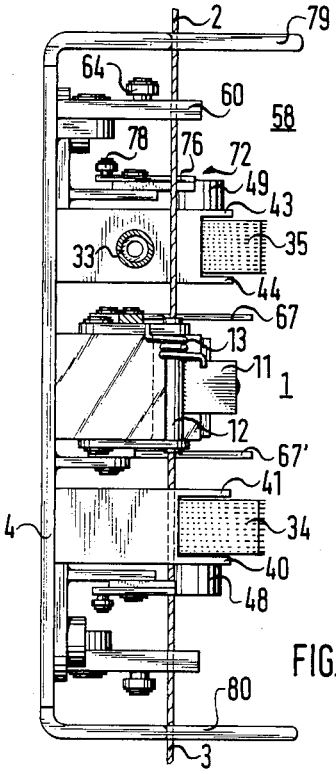
FIG. 4 is a side elevation of the automatic splicer of FIG. 1.
Figure 6:
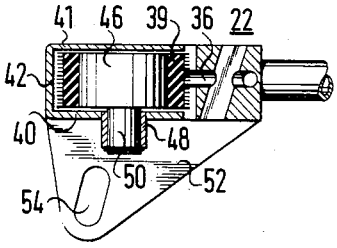
FIG. 6 is a vertical section of the combing means of FIG. 5.
Figure 5:
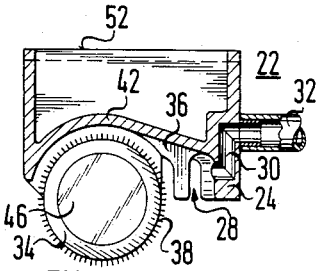
FIG. 5 is a horizontal section of the combing means illustrated in the lower portion of the automatic splicer of FIGS. 1 and 4.

Referring first to the preferred embodiment of FIGS. 1–13, an automatic splicer 1 is shown for splicing spun yarn ends 2,3, which may be open end spun yarns, including plied yarns.

The splicer 1 includes a base plate 4 on which the other parts are mounted. These parts includes a splicing unit 5 that incorporates a splicing chamber 6 to which compressed air is attached and which has a splicing slot 7 in which is received the yarn ends 2,3. The normal path of the yarn is vertical in FIG. 1, with the splicing slot 7 crossing the normal path at the location indicated by the numeral 8 at an acute angle.

A cover 9 is provided for closing the splicing slot 7. For this purpose the cover 9 is connected by a ball-and-socket joint 10 to a lever 11 that is fastened to a hinged bolt 12 and loaded by a wound spiral spring 13, which acts to bias the cover 9 against the surface of the splicing chamber 6. The hinged bolt 12 is mounted on a two-armed lever 14,14′ which pivots on hinge pins 15,15′ mounted on the splicing chamber 6. The lever 14 is mechanically actuated by another lever 16 that is shifted in its longitudinal direction by an actuating device F1.

The splicing chamber 6 includes two compressed air conduits 17 and 18, through which compressed air is introduced into the splicing slot 7 to splice yarn ends therein. The two compressed air conduits 17 and 18 are connected to a supply conduit 19 having a control valve V1 for controlling the feed of compressed air to the conduits 17 and 18 from a source (not shown).

The spun yarn 3 at the bottom of FIG. 1 comes from a supply bobbin (not shown) and the spun yarn 2 at the top of FIG. 1 extends to a take-up bobbin (not shown). FIG. 1 illustrates that a yarn break has occurred, with the spun yarn 2 having a yarn end 20 and the spun yarn 3 *having a yarn end 21, which yarn ends are to be spliced to eliminate the break.*

A combing device 22 is located near the splicing chamber 6 for combing the yarn end 20, and a combing device 23 is located near the splicing chamber 6 for combing the yarn end 21. Each combing device includes a rotatable combing unit. The combing unit in combing device 22 is designated by the numeral 26, and the combing unit in combing device 23 is designated by the numeral 27. The combing device 22 includes a housing 24 that has a longitudinal slot 28 for receiving the spun yarn 2, and the combing device 23 includes a housing 25 having a longitudinal slot 29 for receiving the other spun yarn 3. The longitudinal slot 28 in the housing 24 is located outside the normal yarn path at an acute angle thereto, and the longitudinal slot 29 of the housing 25 is located outside the normal yarn path at an actue angle thereto. The longitudinal slots 28,29 and the splicing slot 7 of the splicing chamber 6 are aligned in a straight line.

A compressed air supply conduit 30 opens into the longitudinal slot 28 of the housing 24 transversely and cbliquely toward the yarn end, and a compressed air supply conduit 31 opens into the longitudinal slot 29 transversely and obliquely toward the yarn end. The compressed air supply conduit 30 is connected by a line 32 to to a control valve V2. Similarly, a compressed air conduit 31 is connected by a line 33 to the same control valve V2, which controls the supply of compressed air from a source (not shown) to the conduits 30 and 31.

The combing unit 26 of the combing device 22 includes a turbine rotor 34 that is drivable by exterior application of compressed air. In the same manner the combing unit 27 of the combing device 23 includes a turbine rotor 35 that is driven by exterior application of compressed air. Exterior air jets are directed against the turbine rotors to cause them to rotate as necessary for the preparation of the yarn ends, as will be described.

The turbine rotors 34,35 are mounted to the side of the longitudinal slots 28,29. The directed jet of compressed air that rotates the turbine rotor 34 is directed through a conduit 36 that is located opposite the compressed air supply conduit 30 and is supplied by the same current of compressed air that enters the longitudinal slot 28. In the same manner, the directed jet of compressed air that rotates the turbine rotor 35 is directed through a conduit 37 that is located opposite the compressed air supply conduit 31 and is supplied by the same current of compressed air that is supplied to longitudinal slot 29.

Both turbine rotors 34 and 35 may be made of plastic and have cylindrical surfaces that are covered with a clothing of needles 38,39. They, thus, resemble the opening cylinders of open end spinning machines. The needles 38,39 are, for example, 0.5 to 1.0 mm. long.

The turbine rotor 34 is enclosed within side baffles 40,41 and a partial circumferential arched baffle 42. The lower side baffle 40 is formed with a well 48 in which the end of an axle 50 is received and on which an enclosed roller bearing 46 is mounted for carrying the turbine rotor 34. Similarly, the turbine rotor 35 is enclosed on its sides by baffles 43 and 44 and is partially covered by a circumferential arched baffle 45. The top side baffle 43 includes a well 49 in which the end of an axle 51 is mounted, with a roller bearing 47 on the axle 51.

In order to assure adjustability, the combing device 22 has a foot portion 52 with a longitudinal slot 54 through which a screw 56 passes to adjustably fasten the combing device 22 to the base plate 4. Similarly, the combing device 23 has a foot portion 53 that has a longitudinal slot 55 through which a screw 57 passes to adjustably fasten the combing device 23 to the base plate 4.

A controlled yarn clamping device and a controlled yarn loop pulling device for each yarn 2,3 are located near the splicing unit 5. The controlled yarn clamping device 58 for the yarn 2 is shown somewhat more clearly in FIG. 3. It comprises a stationary clamping element 60 and an oscillating clamping element 61 that moves in an articulated manner. A lever 64 is attached to the oscillating clamping element 61 for reciprocal movement in a longitudinal direction by an actuation device F2. FIG. 1 shows the yarn clamping device 58 closed and holding the yarn 2.

The yarn clamping device 59 for the yarn 3 similarly includes a stationary clamping element 62 and an oscillating clamping element 63 that is connected to a lever 65 operated by an actuation device F3 for longitudinal reciprocation of the lever 65. FIG. 1 shows the yarn clamping device 59 closed and holding the yarn 3.

The aforementioned yarn loop pulling devices are mounted on a yarn control device 66. The yarn loop pulling devices 67,67' are in the form of oscillating arms mounted on a shaft in a casing 70 connected to the base plate 4, which shaft is connected to an actuation rod 68 that in turn is connected to an actuation device F4. The actuation rod 68 is reciprocable longitudinally by the actuation device F4. FIG. 1 shows the yarn control device 66 in its retracted position.

Yarn severing devices are illustrated in FIG. 1 in line with extensions of the longitudinal slots 28 and 29 of the combing devices 22 and 23. One yarn severing device 71 is located in line with the longitudinal slot 28 and the other yarn severing device 72 is located in line with the longitudinal slot 29. The yarn severing device 71 includes a stationary severing knife blade 73 connected to the base plate 4 and a movable severing knife blade 74 articulated to an operating rod 77 connected to an actuating device F5. FIG. 1 shows the yarn severing device 71 closed after having just severed the excess yarn 20 from the end of the yarn 2.

In the same manner, the yarn severing device 72 includes a stationary severing knife blade 75 mounted on the base plate 4 and a movable severing knife blade 76 articulated to an operating rod 78 that is connected to an actuating device F6 for reciprocal movement in a longitudinal direction. FIG. 1 shows the yarn severing device 72 closed after having just severed the excess yarn 21 from the end of the yarn 3.

To facilitate insertion of the yarn into the splicer, a yarn guide 79 is present on the upper end of the base plate 4 and a yarn guide 80 is present at the lower end. Each yarn guide consists of a horizontal plate having V-shaped slots.

For splicing, the two yarns are first placed into the splicing unit 5 by conventional yarn inserting means (not shown) which come from opposite sides of the splicer. The spun yarn 2 coming from above the splicer is inserted into the open yarn clamping device 58, adjacent the yarn loop pulling device 67, in the splicing slot 7, in the longitudinal slot 28 of the combing device 22, and in the open yarn severing device 71. Similarly, the yarn 3 is inserted from below the splicer into the open yarn clamping device 59, adjacent the yarn loop pulling device 67', in the splicing slot 7, in the longitudinal slot 29 of the combing device 23 and in the open yarn severing device 72.

First, the yarn clamping devices 58 and 59 are closed by the actuation devices F2 and F3. The yarn severing devices 71 and 72 are then actuated to sever the excess yarn from the ends of the yarns 2 and 3 at a predetermined spacing, determined by the location of the severing devices, from the splicing slot 7. FIG. 1 illustrates the splicer in this condition. The two excess ends of yarn 20 and 21 are then removed, as by suction or any other conventional means.

Figure 7:
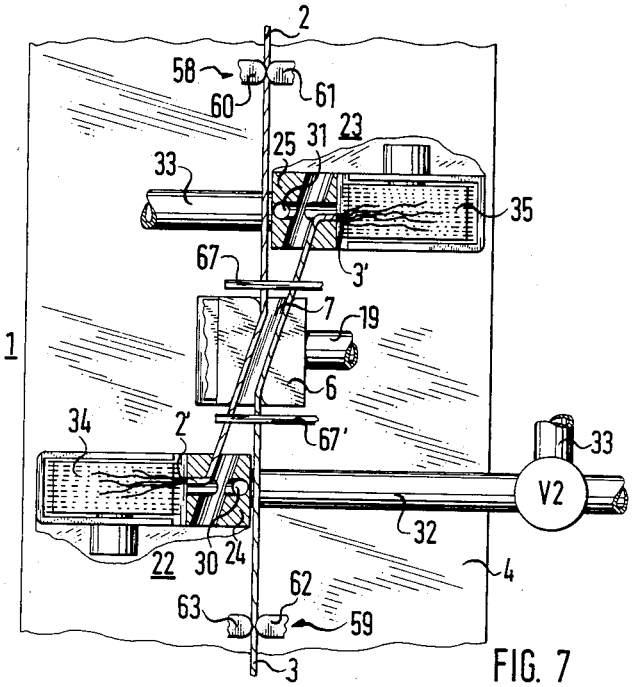
FIG. 7 is a view similar to FIG. 1 with portions removed and portions shown in section, illustrating the operation of the splicer during combing.

Then, the yarn loop pulling devices 67,67' are actuated by the actuation device F4, as indicated in FIG. 7, forming yarn loops in the yarns 2 and 3.

Next, the newly created yarn ends 2' and 3' are prepared for splicing by opening the control valves V2 so that compressed air flows through the two compressed air supply conduits 30 and 31 and across the slots 28 and 29 into the conduits 36 and 37. A part of the compressed air is deflected and escapes through the two longitudinal slots 28 and 29, but a significant part flows through the conduits 36 and 37, entraining the yarn ends 2' and 3', as shown in FIG. 7. At the same time, the two turbine rotors 34 and 35 are being rotated by the air flow. Initially, the yarn ends 2' and 3' do not extend sufficiently into the conduits 36 and 37 to make contact with the needle clothing 38 and 39. The yarn loop pulling devices 67,67' are then advanced in a controlled manner to feed the yarn ends to the combing devices at a controlled feed rate to progressively comb the yarn ends by the needle clothing 38 and 39 progressively from their ends to a predetermined length, e.g. 1.5 cm., corresponding approximately to the length of the splice to be made.

Figure 8:
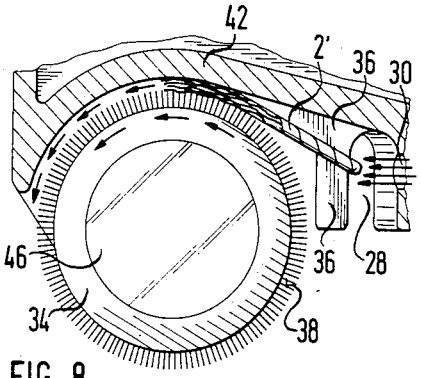
FIG. 8 is a horizontal section of the combing means in the lower left of FIG. 7.
Figure 9:
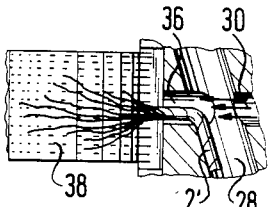
FIG. 9 is a partial vertical section of the combing means of FIG. 8.
Figure 10:
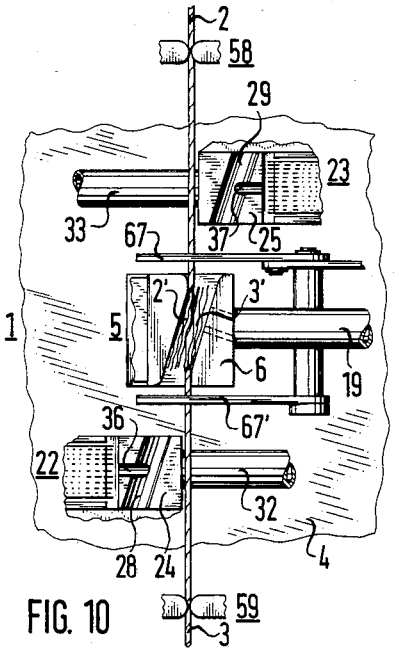
FIG. 10 is a view similar to FIG. 7, showing the yars ends in alignment in the splicing chamber in readiness for splicing.
Figure 11:
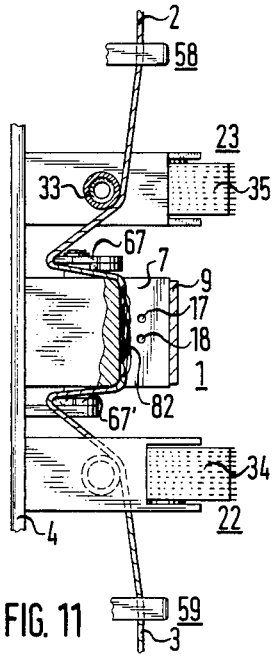
FIG. 11 is a side elevation of the splicer of FIG. 10.
Figure 12:
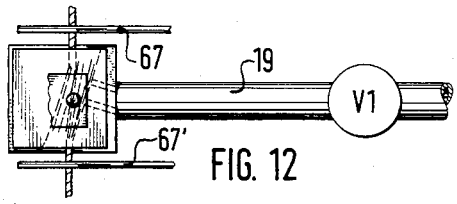
FIG. 12 is a partial elevation of the splicer of FIG. 10.
Figure 13:
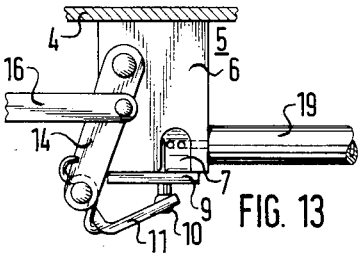
FIG. 13 is a plan of the splicing chamber of the splicer of FIG. 10.

FIGS. 8 and 9 illustrate the combing operation in relation to yarn end 2'. The compressed air flows out of the supply conduit 30, transversely across the longitudinal slot 28 and entrains the yarn end 2' through the conduit 36 in the direction of the turbine rotor 34. Then, the yarn end 2' comes progressively in greater mechanical contact with the needle clothing 38, with the yarn end being loosened thereby and broken down ends first in a combed manner into individual fibers, cleaned and spread, as shown by example in FIG. 9. Particles of dirt and short fibers which would weaken the strength of a splice are blown away.

After a brief period of operation or after several blowing intervals, the control valve V2 is closed again and the yarn control device 66 is actuated by the actuation device F4. The yarn loop pulling devices 67,67' now move into the yarn loop pulling position shown in FIGS. 10–12 in which the yarn ends 2' and 3' are pulled back into alignment alongside each other in the splicing slot 7 in position for splicing. Now, the cover 9 is closed over the splicing slot 7 by the actuation device F1 shown in FIG. 13. The control valve V1 is then opened, directing compressed air into the splicing slot 7, causing the individual fibers of the two yarn ends to be commingled, mixed and hooked into each other so that a splice is formed. Then, the yarn loop pulling devices 67,67' retract to the initial retracted position and the two yarn clamping devices 58 and 59 are opened to release the spliced yarn. Upon resumption of winding by the winding bobbin (not shown), the spliced yarn is pulled from the splicer and the splicer is ready to perform another splicing operation, for which purpose it can be moved to a new splicing location.

Figure 14:
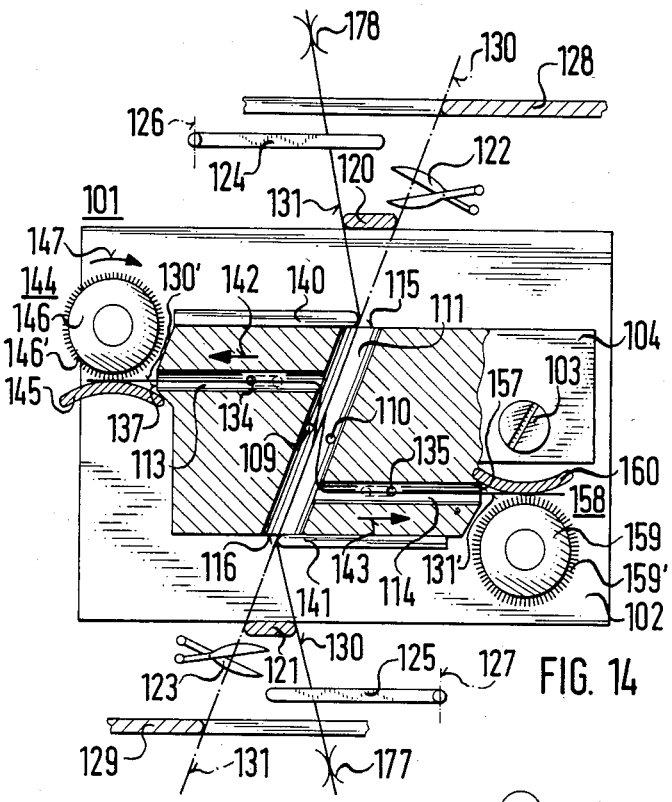
FIG. 14 is a schematic elevation, partially in section, of an alternative embodiment of the automatic yarn splicer of the present invention.
Figure 15:
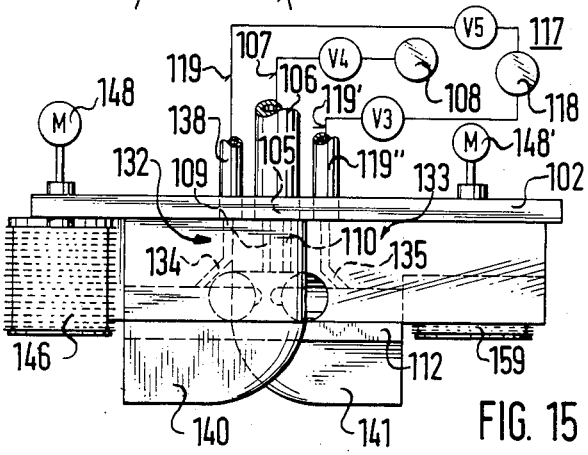
FIG. 15 is a schematic partial plan of the splicer of FIG. 14.

Referring to the alternative embodiment shown in FIGS. 14 and 15, only essential parts are designated as it functions in many respects in the same manner as the embodiment of FIGS. 1–13. In this embodiment the splicer 101 has a base plate 102 on which a splicing chamber 104 is mounted by a screw 103. The base plate 102 has a bore 105 that receives a tube 106 to which a line 107 is connected from a control valve V4 and a source of compressed air 108. Two compressed air injection openings 109 and 110 extend from the tube 106 into a splicing slot 111 in the splicing chamber 104, which slot can be closed by a cover 112 after yarns have been inserted for splicing.

The splicing chamber 104 shown in partial section in FIG. 14 has two yarn feed conduits 113 and 114 extending transversely from the splicing slot 111 for feeding therethrough of yarn ends 130 and 131. The feed slot 113 opens obliquely in the direction of the adjacent end 115 of the splicing slot 111 into the slot in the section located between the compressed air injection openings 109,110 and the upper end 115 of the splicing slot 111. Similarly, the feed slot 114 opens obliquely in the direction of the nearest end 116 of the splicing slot 111 into the slot. Both feed slots 113 and 114 open at the sides of the splicing chamber 104.

The two feed slots 113 and 114 are connected to an air flow control system designated in its entirety by the numeral 117. This control system 117 includes a compressed air source 118 with a control valve V5 and an ejector 132 for the feed slot 113 and a control valve V3 and an injector 133 for the feed slot 114. An injector air line 119 extends from the valve V5 to a tube 138 that is inserted in the base plate 102 and communicates with an air injector conduit 134 that opens obliquely with respect to the splicing slot 111 into the feed slot 113. Another injector air line 119' extends from the valve V3 to the tube 119" into the base plate 102 to an injector air conduit 135 that opens obliquely with respect to the splicing slot 111 into the flow conduit 114.

As seen in FIG. 14, a yarn guide 140 is positioned at the upper end 115 of the splicing slot 111 and a yarn guide 141 is positioned at the lower end 116. In FIG. 15 it is seen that each yarn guide 140 and 141 covers approximately one-half of its end of the splicing slot 111. The yarn guides are attached to the splicing head 104. A cover 112 is provided for covering the entire length of the splicing slot 111 and the feed slots 113 and 114.

The base plate 102 carries a yarn guide plate 120 at the top and a corresponding yarn guide plate 121 at the bottom. A yarn severing device 122 is located above the yarn guide plate 120 and a yarn severing device 123 is located below the yarn guide plate 121. A yarn holding element in the form of a yarn loop pulling device 124 pivoted about an axis 127 is located adjacent the upper yarn severing device 122, and an identical yarn holding element in the form of a yarn loop pulling device 125 pivoted about an axis 127 is located below the lower yarn severing device 123. Another yarn guide plate 128 is located above the upper yarn severing device 122 and a corresponding yarn guide plate 129 is located below the lower yarn severing device 123.

FIG. 14 shows the position of the yarns 130 and 131 to be connected to one another after they have been placed in the splicing slot 111. Yarn 130 comes from the lower right, is placed in the yarn clamping device 177, which is open at the time, adjacent the yarn loop pulling device 125, changes its direction on the yarn guide plate 141, runs through the splicing slot 111 and the symbolically represented open yarn severing device 122, and rests on yarn guide plate 128. The other yarn 131 comes from the upper left and is placed in the yarn clamping device 178, which is open at this time, adjacent the yarn loop pulling device 124, changes its direction on the yarn guide 140, runs through the splicing slot 111 parallel to the yarn 130, passes through the open yarn severing device 123, which is symbolically represented, and rests on yarn guide plate 129.

Both yarn severing devices 122 and 123 are actuated after the cover 112 is closed, the yarn clamping devices 177 and 178 are closed and after partial actuation of the yarn loop pulling devices 124 and 125. A yarn end is produced thereby on each yarn by action of the yarn severing devices 122 and 123, with the excess severed yarn removed by means not shown. To prepare the newly severed yarn ends for splicing, each yarn end must be fed into the nearest yarn feeding slot 113 and 114. This can be done in different ways.

One of the ways for bringing the yarn end 130' created after the separation of yarn 130 into the feed slot 113 consists of first leaving the yarn 131 unsevered and opening control valve V5 to direct flow of air into the feeding slot 113 in conjunction with actuation of the yarn severing device 122 and partial actuation of the yarn loop pulling device 124. The injector action of the air flowing obliquely from the conduit 134 into the feed slot 113, in the direction of the arrow 142, entrains the yarn end 130' as shown in FIG. 14. As soon as this has occurred, the other yarn severing device 123 can be actuated and the valve V3 opened to direct air through the slot 135 obliquely into the feed slot in the direction of the arrow 143. This sequence of operation assures the proper location of the yarn ends for combing and avoids the possibility of both ends being drawn into either one of the two feed slots.

Another procedure for bringing the yarn ends into the feed slots consists of actuating both yarn severing devices and also both control valves simultaneously after closing the yarn clamping devices 177 and 178 and actuating the yarn loop pulling devices 124,125. Both air flows, which are directed in different directions, attempt to entrain both yarns, but each yarn end is finally drawn into the nearest feed slot and retained therein.

As seen in FIGS. 14 and 15, a combing device 144 is located in front of the mouth 137 of the feed slot 113. This combing device 144 includes a roller 146 having needle clothing 146' and which rotates closely adjacent a yarn guide surface 145 mounted on the base plate 102. The roller 146 is driven by a small motor 148 also mounted on the base plate 102. Similarly, a combing device 158 is mounted in front of the mouth 157 of the feed slot 114 and has a roller 159 with needle clothing 159' and which rotates close to a yarn guide surface 160 mounted on the base plate 102. The roller 159 is driven by a small motor 148' mounted on the base plate 102.

When the ends of the yarn ends have been drawn initially into the feed slots 113,114, the severing and loop pulling position them close to but not in contact with the combing devices. The yarn loop pulling devices 124 and 125 are then pivoted back in a controlled manner to feed the yarn ends 130',131' at a controlled feed rate from the ends of the feed slots 113, 114 to the needle clothing 146',159' for progressive combing.

After the yarn ends have been prepared, the splicing is initiated by the yarn ends being pulled back from the feed slots 113 and 114 by further advancing of the yarn loop pulling devices 124 and 125. By pivoting the yarn loop pulling devices 124 and 125 to form longer yarn loops, the yarn ends are correspondingly pulled back. FIG. 14 shows the two yarn loop pulling devices in a fully advanced position. Previously, during the initial yarn insertion in the splicer, the yarn loop pulling devices 124 and 125 were disposed in retracted position out of engagement with the yarn, as indicated in FIG. 14 by the small circles.

After the cover 112 has been closed and the yarn ends have been pulled back into the splicing chamber, the actual splicing takes place. This is accomplished by intermittently opening the valve V4 for brief intervals, causing blasts of air to enter through the air injection openings 109 and 110 into the splicing slot 111. The compressed air flowing in escapes into the open at the ends 115 and 116 of the splicing slot 111 and entrains the air located in the feed slots 113 and 114. The other control valves V5 and V3 are either closed at the latest when the valve V4 is opened or they remain open in certain instances in order to hold the ends in the feed slots. It should be noted that in some operations the yarn ends need not be completely removed from the feed slots when splicing is initiated.

After the splice has been completed and after the valves have closed, the cover 112 is opened, the yarn clamping devices 177 and 178 are opened and the yarn loop pulling devices 124 and 125 are pivoted back into retracted position. The spliced yarn can now be pulled from the splicing slot 111 upon resumption of winding of the yarn.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of splicing spun yarns, including open end spun yarns, plied spun yarns and wrapped or sheathed yarns, comprising feeding yarn ends to mechanical combing means at a controlled feed rate to comb the yarn ends progressively from their ends to a predetermined length corresponding approximately to the length of the subsequent splice, withdrawing the combed yarn ends from the combing means and into alignment for splicing, and splicing the combed and aligned yarn ends.

2. A method of splicing according to claim 1 and characterized further in that said combed yarn ends are drawn into a splicing chamber by said withdrawing from said combing means, and said splicing is performed by applying compressed air into said splicing chamber.

3. A method of splicing according to claim 1 and characterized further by applying air to direct said yarn ends toward said combing means during said feeding of the yarn ends to said combing means.

4. A method of splicing according to claim 3 and characterized further by holding a first of said yarn ends prior to applying air to said first yarn end and while severing excess yarn from a second of said yarn ends at a predetermined spacing from splicing alignment and directing air to said second yarn end, thereafter severing excess yarn from said first yarn end at a predetermined distance from splicing alignment and directing air to said first yarn end, then feeding both yarn ends to said combing means.

5. A method of splicing according to claim 3 and characterized further in that said air is applied prior to said feeding to position said yarn ends for feeding and during said feeding.

6. A method of splicing according to claim 1 and characterized further by pulling said yarn ends toward splicing alignment to position said yarn ends for feeding to said combing means, and said feeding feeds said yarn ends away from splicing alignment to said combing means.

7. A method of splicing according to claim 6 and characterized further by applying air to direct said yarn ends toward said combing means during said feeding of the yarn ends to said combing means.

8. A method of splicing according to claim 6 and characterized further by severing excess yarn from said yarn ends at a predetermined spacing from splicing alignment prior to pulling said yarn ends into position for feeding.

9. A method of splicing according to claim 7 and characterized further by severing excess yarn from said yarn ends at a predetermined spacing from splicing alignment prior to pulling said yarn ends into position for feeding.

10. A method of splicing according to claim 3 and characterized further in that in said applying of air to direct said yarn ends toward said combing means said air is applied to drive said combing means.

11. A method of splicing according to claim 3 and characterized further in that said method is practiced with a splicing chamber having a splicing slot in which said combed yarns are spliced and having yarn feeding slots extending transversely from said splicing slot to said combing means, and said air is applied to direct said yarn ends into said feeding slots.

12. A method of splicing according to claim 11 and characterized further by pulling said yarn ends into said splicing chamber in position for application of air to direct said yarn ends into said feeding slots.

13. A method of splicing according to claim 12 and characterized further by severing excess yarn from said yarn ends at a predetermined spacing from said splicing chamber prior to pulling said yarn ends into position for application of air to direct said yarn ends into said feeding slots.

14. A method of splicing according to claim 13 and characterized further by holding a first of said yarn ends prior to severing, pulling and directing for feeding, while a second of said yarn ends is being severed, pulled, and directed for combing, and thereafter severing, pulling and directing for feeding said first yarn end, and then feeding both yarn ends to said combing means.

15. A method of splicing spun yarns, including open end spun yarns, plied spun yarns, and wrapped or sheathed yarns, using an automatic splicer that has a pair of yarn clamping means, a pair of yarn severing means between said yarn clamping means, a pair of yarn loop pulling means between said yarn severing means, a pair of mechanical yarn combing means between said yarn loop pulling means, means associated with each combing means for applying air to direct yarn ends to said combing means, a splicing chamber between said combing means and having a slot for splicing yarn ends therein, and air splicing means for splicing yarn ends aligned in said splicing slot, said method comprising inserting one yarn to be spliced in one clamping means, at the adjacent loop pulling means, in the splicing slot, at the opposite combing means and in the opposite severing means, inserting a second yarn to be spliced in the other clamping means, at the other loop pulling means, in the splicing slot, at the other combing means and in the opposite severing means, actuating the pair of yarn clamping means, actuating the pair of yarn severing means to sever excess yarn from the yarn ends, and advancing the pair of loop pulling means to pull the severed yarn ends into position for feeding to said pair of combing means, actuating said air applying means to apply air to direct said yarn ends toward said pair of combing means, retracting said pair of loop pulling means to feed said yarn into said pair of combing means under the influence of said applied air at a controlled feed rate to comb the yarn ends progressively from their ends to a predetermined length corresponding approximately to the length of the subsequent splice, advancing said pair of loop pulling means to withdraw said yarn ends from said combing means and into alignment in said splicing slot, and actuating said air splicing means to splice said aligned yarn ends in said splicing slot.

16. An automatic splicer for splicing ends of spun yarn, including open end spun yarns, plied spun yarns, and wrapped or sheathed yarns comprising a splicing chamber having a splicing slot, means for splicing yarn ends aligned in said splicing slot, mechanical yarn combing means, means for feeding yarn ends to said combing means at a controlled feed rate to comb the yarn ends progressively from their ends to a predetermined length corresponding approximately to the length of the subsequent splice and to withdraw the combed yarn ends from said combing means into alignment in said splicing slot for splicing by said splicing means.

17. An automatic splicer according to claim 16 and characterized further in that said splicing means comprises means for applying compressed air to the yarn ends in said splicing slot.

18. An automatic splicer according to claim 16 and characterized further by means for applying air to said yarn ends to direct said yarn ends toward said combing means during feeding of said yarn ends to said combing means by said feeding means.

19. An automatic splicer according to claim 18 and characterized further in that said yarn feeding and withdrawing means is operable to pull said yarn ends toward said splicing slot into position for feeding to said combing means away from said splicing slot.

20. An automatic splicer according to claim 19 and characterized further in that said yarn feeding and withdrawing means comprises a pair of yarn loop pulling means operable to advance to form yarn loops that pull said yarn ends and retract to reduce said yarn loops to feed said yarn ends to said combing means and to advance to increase the yarn loops and withdraw the combed yarn ends from said combing means into splicing alignment in said splicing slot.

21. An automatic splicer according to claim 19 and characterized further by means for severing excess yarn from said yarn ends at a predetermined spacing from said splicing slot prior to operation of said yarn feeding and withdrawing means.

22. An automatic splicer according to claim 18 and characterized further in that said air applying means applies said air to drive said combing means.

23. An automatic splicer according to claim 22 and characterized further in that said combing means comprises a freely rotatable roller having a cylindrical combing surface clothed with combing teeth, and said air applying means applies said air to said combing teeth to cause rotation of said combing roller.

24. An automatic splicer according to claim 18 and characterized further in that said splicing chamber is formed with yarn feeding slots extending transversely from said splicing slot to said combing means, and said air applying means applies said air to direct said yarn ends into said yarn feeding slots.

25. An automatic splicer for splicing ends of spun yarn, including open end spun yarns, plied open end spun yarns, and wrapped or sheathed yarns comprising a pair of yarn clamping means for clamping a yarn to be spliced in each clamping means, a pair of yarn severing means between said yarn clamping means for severing excess yarn from ends of yarn clamped by oppposite clamping means, a pair of yarn loop pulling means between said yarn severing means for pulling yarn loops in yarns clamped in adjacent clamping means, a pair of mechanical yarn combing means between said yarn loop pulling means for combing the ends of yarns clamped in the opposite clamping means, means associated with each yarn combing means for applying air to direct yarn ends to said combing means, a splicing chamber between said combing means and having a slot for splicing yarn ends therein, and air splicing means for splicing yarn ends aligned in said splicing slot, said yarn loop pulling means being operable to advance to pull the severed yarn ends into position for feeding to said pair of combing means and being retractable to feed said yarn ends into said combing means at a controlled feed rate under the influence of the air from said air applying means to comb the yarn ends progressively from their ends to a predetermined length corresponding approximately to the length of the subsequent splice, said yarn loop pulling means being further operable to advance to withdraw said yarn ends from said combing means and into alignment in said splicing slot for splicing.

* * * * *